US010760427B2

(12) United States Patent
Baralon

(10) Patent No.: US 10,760,427 B2
(45) Date of Patent: Sep. 1, 2020

(54) SECONDARY FLOW CONTROL

(71) Applicant: ROLLS-ROYCE plc, London (GB)

(72) Inventor: Stephane M M Baralon, Derby (GB)

(73) Assignee: Rolls-Royce plc, London ( * ) Notice: Subject to any disclaimer, the term of this patent is extended or adjusted under 35 U.S.C. 154(b) by 91 days.

(21) Appl. No.: 16/012,891

(22) Filed: Jun. 20, 2018

(65) Prior Publication Data

US 2018/0371919 A1 Dec. 27, 2018

(30) Foreign Application Priority Data

Jun. 23, 2017 (GB) ..... 1710076.9

(51) Int. Cl.

*F01D 5/14* (2006.01)
*F01D 17/10* (2006.01)
*F01D 9/04* (2006.01)

(52) U.S. Cl.

CPC ..... *F01D 5/145* (2013.01); *F01D 5/141* (2013.01); *F01D 9/041* (2013.01); *F01D 17/105* (2013.01); *F05D 2220/32* (2013.01); *F05D 2240/12* (2013.01); *F05D 2240/20* (2013.01); *F05D 2260/213* (2013.01); *F05D 2260/606* (2013.01); *F05D 2270/17* (2013.01)

(58) Field of Classification Search

None

See application file for complete search history.

(56) References Cited

U.S. PATENT DOCUMENTS 3,741,285 A * 6/1973 Kuethe ..... B64C 21/10 165/181
4,290,781 A * 9/1981 Wang ..... B01D 53/24 95/35
4,863,121 A * 9/1989 Savill ..... B63B 1/34 244/200
5,437,421 A * 8/1995 Nosenchuck ..... B64C 23/005 244/130
2002/0134891 A1* 9/2002 Guillot ..... B64C 3/00 244/204.1
2005/0106017 A1* 5/2005 Segota ..... B63B 1/248 416/1
2005/0238483 A1 10/2005 Guemmer (Continued)

FOREIGN PATENT DOCUMENTS

EP 1536146 A2 6/2005
EP 2267274 12/2010

(Continued)

OTHER PUBLICATIONS

Great Britain Search Report dated Nov. 14, 2017, issued in GB Patent Application No. 1710076.9.

(Continued)

*Primary Examiner* — Michael Lebentritt
(74) *Attorney, Agent, or Firm* — Barnes & Thornburg LLP

(57) ABSTRACT

A slot is provided in an endwall of a flow passage, for example between two stator vanes or rotor blades of a gas turbine engine. The length direction of the flow passage is aligned substantially with the main flow through the flow passage. The alignment of the slot means that the "over-turned" boundary layer flow can be extracted through the slot but with minimal impact on the mainstream flow.

17 Claims, 3 Drawing Sheets

(56) References Cited

U.S. PATENT DOCUMENTS

| | | | | |
|---|---|---|---|---|
| 2011/0097189 | A1* | 4/2011 | Sandoval | F01D 1/36<br>415/68 |
| 2015/0047352 | A1* | 2/2015 | Glezer | F02C 1/05<br>60/641.8 |
| 2017/0023437 | A1* | 1/2017 | Diaz Parrilla | B64F 5/60 |
| 2018/0238185 | A1* | 8/2018 | Shapiro | F01D 9/023 |

FOREIGN PATENT DOCUMENTS

| | | | |
|---|---|---|---|
| FR | 2166494 | A5 | 8/1973 |
| GB | 812273 | A | 4/1959 |
| JP | S5267404 | | 6/1977 |
| JP | H10331604 | A | 12/1998 |

OTHER PUBLICATIONS

Extended European Search Report dated Oct. 30, 2018 and issued in connection with European Patent Appln. No. 18176241.0.
European Office Action dated Aug. 23, 2019 and issued in connection with European Patent Appln. No. 18176241.0.

* cited by examiner

SECONDARY FLOW CONTROL

CROSS-REFERENCE TO RELATED APPLICATIONS

This specification is based upon and claims the benefit of priority from UK Patent Application Number 1710076.9 filed on 23 Jun. 2017, the entire contents of which are incorporated herein by reference.

BACKGROUND

Technical Field

Aspects of the present disclosure relate to control of secondary flow. Aspects of the present disclosure relate to removal of boundary layer flow, for example in a flow passage.

Description of the Related Art

During operation of a gas turbine engine, flow generally passes through a series of rotor stages and stator stages. Each rotor stage comprises a plurality of aerofoils in the form of rotating rotor blades. Each stator stage comprises a plurality of aerofoils in the form of static stator vanes. As the flow passes through a stage, the aerofoils cause the flow to turn, resulting in a differential pressure field in the flow.

This differential pressure field in the flow results in the formation of so-called secondary flow. Such secondary flow (or secondary flows) may be described as flow that is not aligned with the mainstream flow, such as cross-flows or vortices. An example of secondary flow through a rotor stage or stator stage of a gas turbine engine is the formation of a vortex that typically forms on the suction surface (typically towards the rear of the suction surface) of an aerofoil in either a rotor stage or a stator stage. Such a vortex, and indeed secondary flow in general, represents losses and/or non-uniformities in the flow so is generally unwanted.

It is desirable to be able to reduce the secondary flow in turbomachinery, for example to be able to reduce the secondary flow through rotor and/or stator stages of a gas turbine engine.

SUMMARY

According to an aspect, there is provided a flow passage. The flow passage comprises a first aerofoil having a first camber. The flow passage comprises a second aerofoil having a second camber and being spaced from the first aerofoil in a pitch direction. The flow passage comprises an endwall between the first and second aerofoils. The first and second aerofoils extend from the endwall in a spanwise direction of the aerofoils. A slot is formed in the endwall for removal of boundary layer flow from the endwall, the slot having a length direction and a width direction, with the length dimension being greater than the width dimension, and the length direction is more aligned with the direction of the first camber than it is with the pitch direction. The minimum distance between the slot and the camber line of the first aerofoil is in the range of from 0.25 and 4 times (for example 0.5 and 3 times, for example 1 and 2 times) the minimum distance between the slot and the camber line of the second aerofoil at all points along the length of the slot.

The slot may be an opening formed in the endwall. The length dimension may be the longest dimension of the slot. The length dimension may be referred to as the longitudinal dimension. The length direction may be is more aligned with the direction of the first camber than it is with the pitch direction along the entire length of the slot.

According to an aspect, there is provided a method of removing boundary layer flow from the flow through a stage of a gas turbine engine, the stage comprising multiple rotor blades or stator vanes extending from an endwall. The method comprises determining the flow direction of mainstream flow through the stage during use. The method comprises determining the flow direction of boundary layer flow next to the endwall during use. The method comprises providing a slot in the endwall between two neighbouring stator vanes or rotor blades, the slot having a length direction and a width direction with the length dimension being greater than the width dimension. The method comprises aligning the length direction more closely to the flow direction of mainstream flow through the stage during use than to the flow direction of the boundary layer flow next to the endwall during use. The method comprises positioning the slot such that the minimum distance between one of the stator vanes or rotor blades is in the range of from 0.25 and 4 times (for example 0.5 and 3 times, for example 1 and 2 times) the minimum distance between the slot and the respective neighbouring stator vane or rotor blade at all points along the length of the slot.

According to an aspect, there is provided a gas turbine engine comprising: a rotor stage comprising rotor blades extending from a rotor endwall; and a stator stage comprising stator vanes extending from a stator endwall. The rotor endwall and/or the stator endwall comprises a slot provided between respective neighbouring rotor blades or stator vanes for removal of boundary layer flow from the endwall, the slot having a length direction and a width direction with the length dimension being greater than the width dimension. The length direction is more closely aligned with the streamwise direction of the main flow through the respective stage than it is with the direction perpendicular to the streamwise direction of the main flow through the respective stage. The streamwise direction of the main flow may be the streamwise direction during use. The minimum distance between the slot and one of the stator vanes or rotor blades is in the range of from 0.25 and 4 times (for example 0.5 and 3 times, for example 1 and 2 times) the minimum distance between the slot and the respective neighbouring stator vane or rotor blade at all points along the length of the slot.

According to an aspect, there is provided a turbomachine comprising a flow passage as described and/or claimed herein. The turbomachine may be an axial flow turbomachine. The turbomachine may be a gas turbine engine, for example a turbofan gas turbine engine. Wherever the term "turbomachine" is used herein, it may refer to a gas turbine engine of any sort.

According to an aspect, there is provided an axial flow turbomachine, such as a gas turbine engine. The axial flow turbomachine may comprise at least one rotor stage comprising a plurality of rotor blades. The axial flow turbomachine may comprise at least one stator stage comprising a plurality of stator vanes. The axial flow turbomachine comprises a flow passage as described and/or claimed herein. In such an arrangement, the first and second aerofoils of the flow passage are either neighbouring rotor blades of a rotor stage or neighbouring stator vanes of a stator stage. Such an arrangement comprises a slot in an endwall, such as that described and/or claimed herein. The rotor stage(s) and/or stator stage(s) having the slot may be part of a compressor or a turbine.

In an axial flow turbomachine, the spanwise direction of the aerofoils in the flow passage may be the same as the radial direction of the turbomachine. The pitch direction may be the same as the circumferential direction. The slot may be arranged such that the length direction is more aligned with the direction of the first camber than it is with the circumferential direction. The slot may be arranged such that the length direction is more aligned with the axial direction than it is with the circumferential direction.

An axial flow turbomachine may comprise at least one rotor stage that has a slot (such as described and/or claimed herein) formed between each pair of neighbouring rotor blades. The rotor stage may be, for example, the fan of a turbofan gas turbine engine. The slot may be formed in an annulus filler. The endwall may be a rotating endwall, such as an annulus filler.

An axial flow turbomachine may comprise at least one stator stage that has a slot (such as described and/or claimed herein) formed between each pair of neighbouring stator vanes. The endwall may be a stationary (non-rotating) endwall. The stator stage may be, for example, an outlet guide vane (or OGV) of a gas turbine engine.

By arranging the slot as described and/or claimed herein, the secondary flow (for example the losses from the secondary flow) can be reduced. A significant proportion (for example the majority, or substantially all) of the boundary layer flow (for example in terms of mass flow) may be removed through the slot, but with minimal (for example substantially no) impact on the freestream (or mainstream) flow. The boundary layer may be "overturned" during use compared with the freestream flow. This may be because it has lower momentum that the mainstream flow, and so the pressure differential created by the aerofoils—which is substantially consistent through the flow (i.e. through both the boundary layer flow and the freestream flow)—has a greater turning effect on the low momentum boundary layer flow than on the freestream flow. This "overturned" boundary layer flow may itself be considered as secondary flow and/or may generate other secondary flow structures, such as vortices formed on the suction surface of aerofoils where the overturned boundary layer flow impinges the aerofoil surface. Accordingly, removing (or reducing) the boundary layer through the slot may reduce the secondary flow, thereby reducing losses and improving efficiency.

Arranging the slot as described and/or claimed herein may be particularly effective in removing the overturned boundary layer flow.

Positioning the slot in a central region of the passage between the blades (for example the such that the minimum distance between the slot and the camber line of the first aerofoil is in the range of from 0.25 and 4 times the minimum distance between the slot and the camber line of the second aerofoil at all points along the length of the slot) may be particularly effective in removing the overturned boundary layer, for example because in this generally central region of the flow passage the difference in flow direction between the boundary layer flow and the freestream flow may be much greater than towards the surfaces of the aerofoils, where both the boundary layer and the freestream flow are physically constrained by the aerofoil surfaces.

The first and second aerofoils of the flow passage may be substantially the same as each other. The first camber of the first aerofoil may be the same as the second camber of the second aerofoil.

The length direction of the slot may be within 45 degrees of the direction of the first camber, for example within 40 degrees, for example within 35 degrees, for example within 30 degrees, for example within 25 degrees, for example within 20 degrees, for example within 15 degrees, for example within 10 degrees, for example within 5 degrees, for example generally and/or substantially aligned with the direction of the first camber.

The slot (that is, the length direction of the slot) may be said to be more aligned with the mainstream flow direction than perpendicular to the mainstream flow direction during use. For example, the slot (that is, the length direction of the slot) may be generally aligned with the mainstream flow direction during use. For example, the slot (that is, the length direction of the slot) may be within 45 degrees, for example within 40 degrees, for example within 35 degrees, for example within 30 degrees, for example within 25 degrees, for example within 20 degrees, for example within 15 degrees, for example within 10 degrees, for example within 5 degrees, for example generally and/or substantially aligned with the mainstream flow direction during use. The length direction of the slot may change along the slot, for example so as to be substantially aligned with the camber direction along its length.

The slot may take any desired form compatible with the present disclosure. For example, the slot may be an opening in an otherwise smooth, continuous surface. By way of further example, the slot may be raised on one side relative to the other side, for example one of the sides in the length direction may be raised relative to the other side in the length direction.

The slot may be said to be formed between a pressure surface of the first aerofoil and a suction surface of the second aerofoil. The slot may be an opening formed in the endwall that points towards the pressure surface of the first aerofoil. For example, such an opening may point in a direction (that is, may be normal to a direction) that has a component, for example a major component, towards the pressure surface of the first aerofoil.

An edge of the slot that is closest to the pressure surface of the first aerofoil may be lower (which may mean radially inboard in an axial flow turbomachine and/or in the opposite direction to the direction in which the first and second aerofoils extend from the endwall) than an edge of the slot that is closest to the suction surface of the second aerofoil. For example, the endwall may be said to be raised (i.e. in the spanwise/radial direction) on the side of the slot closer to the suction surface of one blade compared to the side of the slot closer to the pressure surface of another blade. This may create a "mouth" into which the overturned boundary layer flow may be captured.

The flow may simply flow into the slot rather than being sucked into the slot. This may utilise a ram effect to capture the flow. Alternatively, suction may be used to draw flow into the slot using a static pressure differential. In such an arrangement, the slot may be connected to a suction source at its downstream end. The suction source may be passive, in that a substantially constant suction is applied throughout operation, or may be active, in that the suction (for example the downstream pressure) may be modulated and/or controlled depending on the operating condition, for example depending on the operating condition of an engine in which the slot is used.

The flow extracted through the slot in use may be used or vented in any desired position. Purely by way of example, the extracted flow may be used in a heat exchanger. Thus, the slot may be connected (for example via a fluid conduit, such as a pipe) to a heat exchanger. The heat exchanger may be any type of heat exchanger, such as a matrix heat exchanger, for example. The heat exchanger may be a heat exchanger of a gas turbine engine. For example, the heat exchanger may be an oil cooler. The heat exchanger may be part of a geared turbofan, comprising a gearbox located between a turbine and the fan, and may be used to cool oil from the gearbox.

The skilled person will appreciate that except where mutually exclusive, a feature described in relation to any one of the above aspects may be applied to any other aspect. Furthermore except where mutually exclusive any feature described herein may be applied to any aspect and/or combined with any other feature described herein.

DESCRIPTION OF THE DRAWINGS

Embodiments will now be described by way of example only, with reference to the Figures, in which.

DETAILED DESCRIPTION

Figure 1:
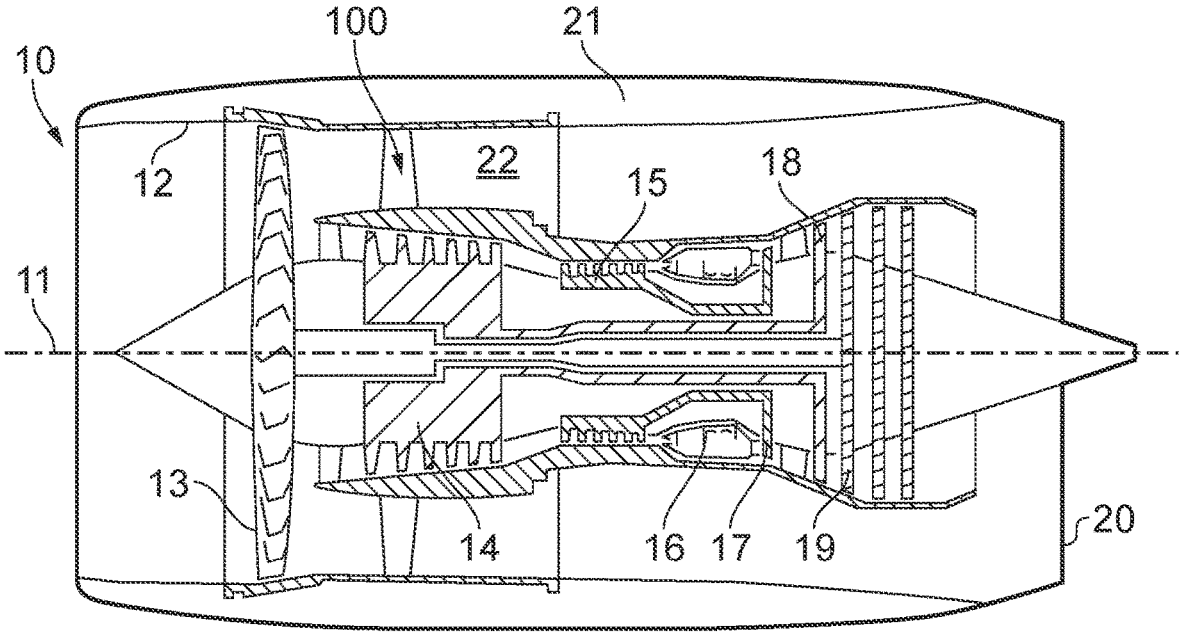
FIG. 1 is a sectional side view of a gas turbine engine.

With reference to FIG. 1, a gas turbine engine is generally indicated at 10, having a principal and rotational axis 11. The engine 10 comprises, in axial flow series, an air intake 12, a propulsive fan 13, an intermediate pressure compressor 14, a high-pressure compressor 15, combustion equipment 16, a high-pressure turbine 17, an intermediate pressure turbine 18, a low-pressure turbine 19 and an exhaust nozzle 20. A nacelle 21 generally surrounds the engine 10 and defines both the intake 12 and the exhaust nozzle 20.

The gas turbine engine 10 works in the conventional manner so that air entering the intake 12 is accelerated by the fan 13 to produce two air flows: a first air flow into the intermediate pressure compressor 14 and a second air flow which passes through a bypass duct 22 to provide propulsive thrust. The intermediate pressure compressor 14 compresses the air flow directed into it before delivering that air to the high pressure compressor 15 where further compression takes place.

The compressed air exhausted from the high-pressure compressor 15 is directed into the combustion equipment 16 where it is mixed with fuel and the mixture combusted. The resultant hot combustion products then expand through, and thereby drive the high, intermediate and low-pressure turbines 17, 18, 19 before being exhausted through the nozzle 20 to provide additional propulsive thrust. The high 17, intermediate 18 and low 19 pressure turbines drive respectively the high pressure compressor 15, intermediate pressure compressor 14 and fan 13, each by suitable interconnecting shaft.

Other gas turbine engines to which the present disclosure may be applied may have alternative configurations. By way of example such engines may have an alternative number of interconnecting shafts (e.g. two) and/or an alternative number of compressors and/or turbines. Further the engine may comprise a gearbox provided in the drive train from a turbine to a compressor and/or fan.

Aspects of the present disclosure relate to the control of secondary flow, such as (by way of example) boundary layer flow and the flow structures caused by boundary layer flow. Such secondary flows could occur at various positions through the gas turbine engine 10, for example in any of the stator or rotor stages of any of the fan 13, compressors 14, 15 or turbines 16, 17, 18, or indeed on/from any surface of the gas turbine engine. Accordingly, the present disclosure may be used at a number of different positions in the engine 10.

The gas turbine engine 10 comprises a stage of outlet guide vanes (OGVs) 100 extending across the bypass duct 22, which therefore sit in the bypass flow through the bypass duct 22. Each OGV 100 takes the form of a large stator vane, and thus may be referred to as an aerofoil or aerofoil component. A plurality of OGVs 100 is typically provided as an annular array in the bypass duct 22. Purely by way of example, an arrangement of the present disclosure is described below in relation to the outlet guide vanes 100.

The gas turbine engine 10 may comprise a flow passage 130 and/or other feature in accordance with the present disclosure, and thus may itself be in accordance with the present disclosure.

Figure 2:
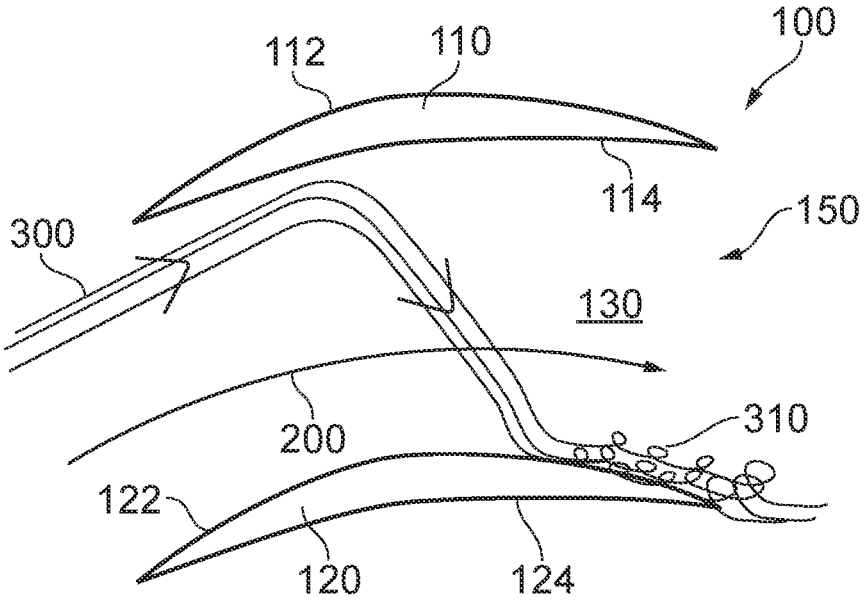
FIG. 2 is a schematic view showing secondary flow through a flow passage.

FIG. 2 illustrates a typical secondary flow between two aerofoils (which, throughout the present disclosure, may be for example stator vanes which do not rotate in use or rotor blades which do rotate in use). In the FIG. 2 example, the aerofoils are stator vanes 110, 120 in the form of OGVs 110, 120 from an OGV stage 100.

Each OGV 110, 120 has a suction surface 112, 122 and a pressure surface 114, 124. A pressure gradient exists in the flow passage 130 formed between the OGVs 110, 120, with the static pressure generally decreasing from the pressure surface 114 of one OGV 110 to the suction surface 122 of a neighbouring OGV 120.

In use, the mainstream flow, indicated schematically by arrow 200 in FIG. 2, follows the general shape of the flow passage 130, for example in the axial-circumferential plane of FIG. 2. This mainstream flow 200 may substantially follow the camber of the OGVs 110, 120.

However, the lower momentum boundary layer flow 300 close to the endwall 150, which extends substantially perpendicularly to the radial direction, is also subjected to substantially the same pressure gradient through the flow passage 130 as the mainstream flow 200. Because the boundary layer flow 300 has lower momentum that the mainstream flow 200, the pressure gradient causes greater turning than that experienced by the mainstream flow. This may be referred to as "over-turning". This over-turning is clearly shown in schematic form in FIG. 2, with the boundary layer flow 300 being diverted significantly towards the suction surface 122 of one of the aerofoils 120, and away from the pressure surface 114 of the neighbouring aerofoil 110.

As a result of the over-turning, the boundary layer flow 300 may produce other secondary flow structures, which may represent further flow losses, thereby decreasing the efficiency of the gas turbine engine 10. For example, in FIG. 2, the over-turned boundary layer flow 300 impinges the suction surface 122 of the aerofoil 120, creating a secondary flow structure 310, which may be in the form of a vortex and may be towards the trailing edge portion of the aerofoil 120.

Figure 3:
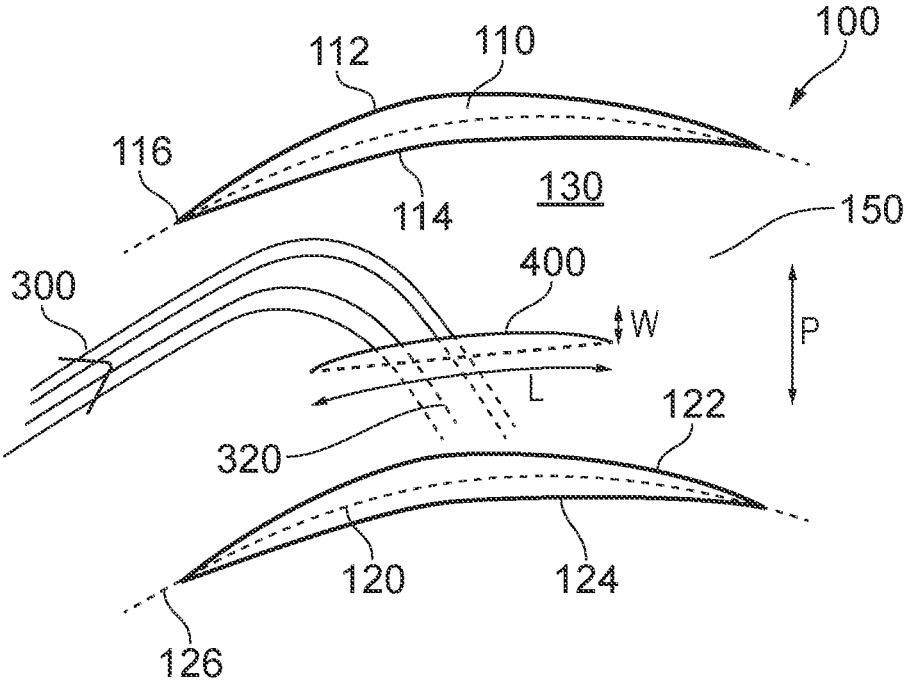
FIG. 3 is a schematic view showing secondary flow through a flow passage according to an example of the present disclosure.

FIG. 2 thus shows a schematic representation of a typical flow through a flow passage 130, which may be between two aerofoils 110, 120, for example of an OGV stage 100. FIG. 3 shows a schematic representation of the FIG. 2 arrangement, but with the inclusion of a slot 400 in the endwall 150, in accordance with an example of the present disclosure.

The slot 400 is formed in the endwall 150. The endwall 150 may be, for example, the radially inner boundary of the flow passage 130 that extends between the first and second OGVs 110, 120. Of course, in other arrangements in accordance with the present disclosure, the endwall 150 may be other walls and/or flow boundaries, for example a radially outer flow boundary.

The slot 400 has a length l and a width w. The length l is greater than the width w. Purely by way of example, in any arrangement in accordance with the present disclosure, the aspect ratio of the length l to the width w may be greater than 2, for example greater than 3, for example greater than 5, for example greater than 10, for example greater than 100.

Figure 4:
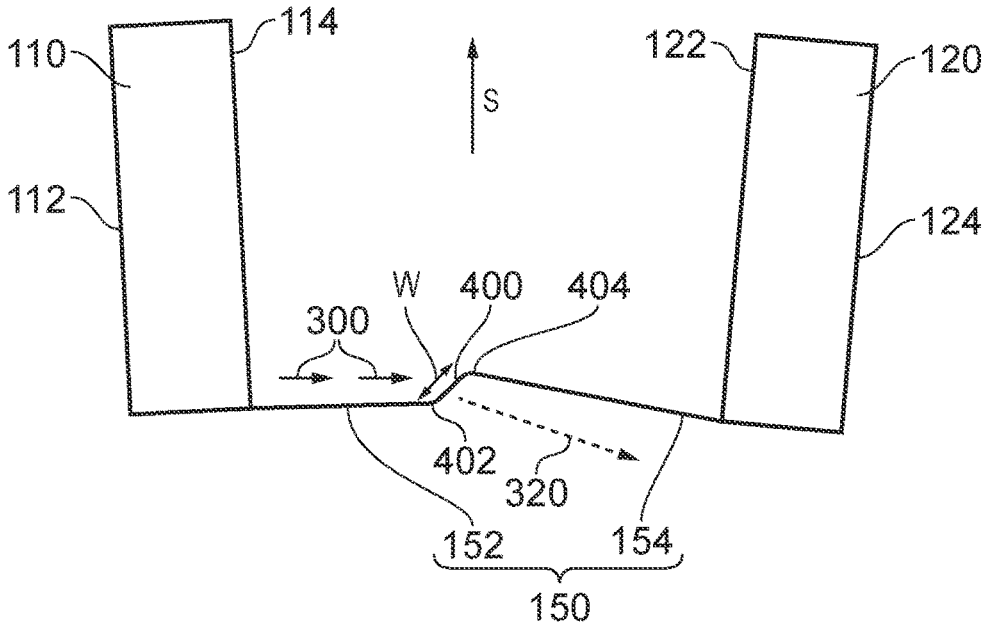
FIG. 4 is an alternative schematic view showing a flow passage according to an example of the present disclosure.

As shown in FIGS. 3 and 4, the width direction w of the slot 400 may be substantially aligned with a pitch direction p that extends between the neighbouring aerofoils 110, 120 (which may be substantially the same as the circumferential direction, for example in an axial flow turbomachine 10 such as that illustrated in FIG. 1), a spanwise direction s of the aerofoils (which may be substantially the same as the radial direction, for example in an axial flow turbomachine 10 such as that illustrated in FIG. 1), or a combination of the pitch direction p and spanwise direction s.

By way of example, FIGS. 3 and 4 show that in the illustrated example, the width direction w has a component in both the pitch (or circumferential) direction p and the spanwise (or radial) direction s. In the example illustrated in FIG. 4, the component of the width direction w in the spanwise direction s is formed by offsetting a portion 154 of the endwall 150 that is towards the aerofoil 120 having its suction surface 122 defining the passage 130 in the spanwise direction s (or the radially increasing direction) compared with the portion 152 of the endwall 150 that is to towards the aerofoil 110 having its pressure surface 114 defining the passage 130. In this arrangement, the edge 402 of the slot that is closer to the pressure surface 114 of the first aerofoil 110 is lower, in the spanwise and/or radial sense, than the edge of the slot 404 that if closer to the suction surface 122 of the second aerofoil 120. Other arrangements may be different, for example with the portions 152, 154 on either side of the slot 400 not being offset relative to each other in the spanwise (or radial) direction s.

The length direction l of the slot 400 may be more aligned with the direction of the camber 116, 126 of one or both of the aerofoils 110, 120 (which may have the same camber, as in the FIG. 3 example) than it is with a direction perpendicular to the direction of the camber(s) 116, 126. The length direction l of the slot 400 may be more aligned with the direction of the camber 116, 126 of one or both of the aerofoils 110, 120 (which may have the same camber, as in the FIG. 3 example) than it is with the pitch (or circumferential) direction p. As in the example of FIGS. 3 and 4, the length direction l may be more aligned with an axial direction 11 of a gas turbine engine 10 than it is with either the circumferential direction or radial direction of the engine 10. The slot 400, for example the length direction l of the slot 400, may be said to have a significant component (for example be within 45 degrees of, for example 30 degrees of, for example 20 degrees of, for example 10 degrees of, for example 5 degrees of, for example 2 degrees of, for example be substantially aligned with) the perpendicular direction to the over-turned boundary layer flow.

The slot 400 may be described as being elongate. The slot 400 may be described as being elongated in the direction of the mainstream flow 200 and/or in the direction of the camber 116, 126 of the aerofoils 110, 120.

As shown in FIGS. 3 and 4, a substantial portion 320 of the over-turned boundary layer flow 300 is removed through the slot 400. Purely by way of example, at least 50%, for example at least 60%, for example at least 70%, for example at least 80%, for example at least 90%, for example at least 95%, for example at least 99% or substantially all of the boundary layer flow 300 may be removed through the slot 400. The slot 400 may thus help to reduce and/or substantially eliminate the unwanted secondary flows, such as the overturned boundary layer flow 300 and the vortex 310 of the FIG. 2 example, thereby improving engine efficiency.

The slot 400 is positioned generally centrally between the first and second aerofoils 110, 120. This may be particularly effective in capturing the overturned boundary layer flow 300. For example, the minimum distance between the slot 400 (for example an edge of the slot 400) and the camber line 116 of the first aerofoil 110 may be in the range of from 0.25 and 4 times the minimum distance between the slot 400 and the camber line 126 of the second aerofoil 120 at all points along the length of the slot.

By forming the slot 400 as described and/or claimed herein (for example aligning the length l and/or width w of the slot 400 as described and/or claimed herein), the effect of the presence of the slot 400 on the mainstream flow 200 may be reduced and/or substantially eliminated. Accordingly, the slot 400 may be said to enable removal of the unwanted, low momentum, boundary layer flow whilst substantially minimizing parasitic losses.

Figure 5:
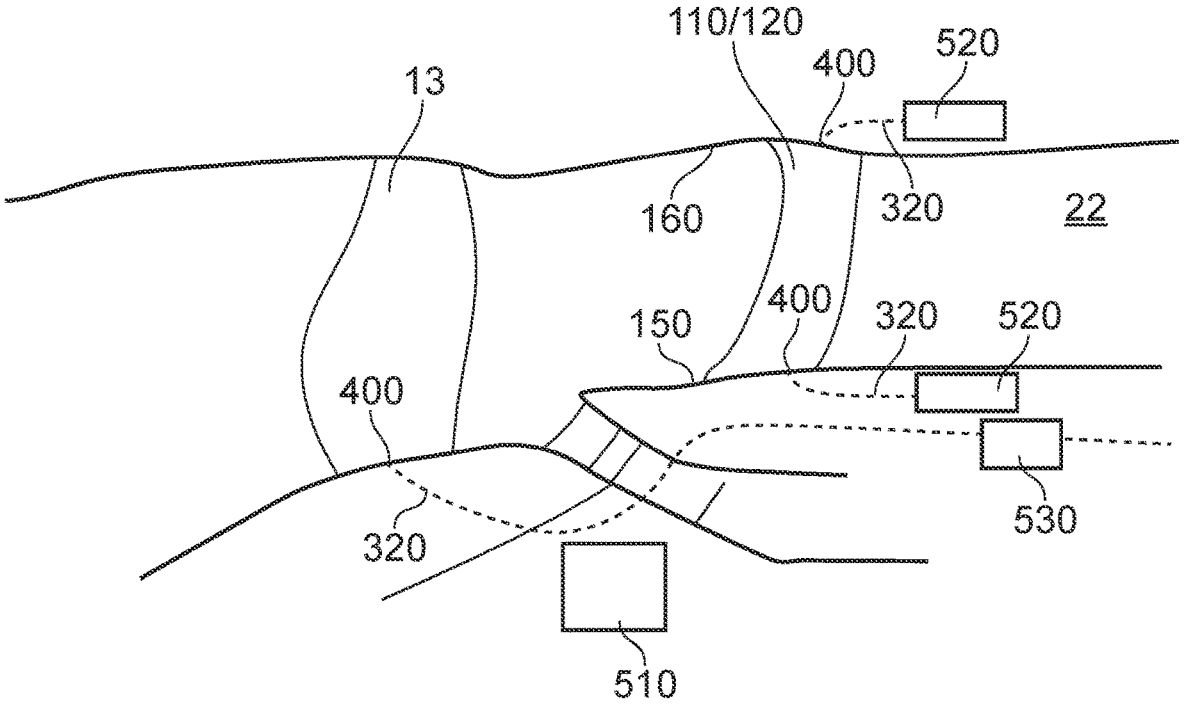
FIG. 5 is a schematic cross-sectional view showing a part of a gas turbine engine.

The flow 320 removed through the slot 400 may be used and/or ejected in any suitable location and/or for any suitable purpose. For example, where the slot 400 is provided to a gas turbine engine 10, the extracted flow 320 may be used to cool other components/other parts of the engine, for example either directly (for example through impingement and/or surface cooling) or via a heat exchanger (such as a matrix heat exchanger. By way of further example, the extracted flow 320 may be used as part of a tip clearance control (TCC) arrangement, for example either directly (through impingement of the extracted flow onto a casing, for example), or by using the extracted flow in an actuator used to control the supply of temperature-controlled flow to a casing. By way of further example, the extracted flow 320 may be used to control an actuator of any type, for example a pneumatic actuator, for example in a gas turbine engine 10. FIG. 5 schematically illustrates some examples of how/where the extracted flow 320 may be used in a gas turbine engine 10 application.

For example, flow 320 is shown as being used to cool a power gearbox 510. Such a power gearbox 510 may be used in the power transmission path of a gas turbine engine 10, for example between a low pressure turbine 19 and the fan 13 so as to reduce the rotational speed of the fan 13 relative to the low pressure turbine 19 to which it is connected. In the FIG. 5 arrangement, extracted flow 320 is shown as being removed from a slot 400 in a fan stage 13. The arrangement of the slot 400, for example in terms of its length, width and orientation, may be substantially as described above in relation to FIGS. 3 and 4. The extracted flow 320 from the fan stage 13 may be used, for example, to directly cool the power gearbox 510 or used in a matrix cooler which may be referred to as a heat exchanger), for example to cool oil from the power gearbox 510.

The FIG. 5 arrangement shows extracted flow 320 (in this case from the fan 13, although it could be from a slot 400 located anywhere in the engine) passing through a valve 530. The valve 530 may be used to control the amount of flow 320 extracted through the slot, for example depending on the engine operating conditions. The valve 530 may thus be said to control the back-pressure (or exit pressure) applied to the slot 400. Additionally or alternatively, the valve 500 may be used to control the flow rate to another component, such as an actuator and/or a tip clearance control system. Any arrangement according to the present disclosure may or may not be provided with such a valve 530.

The FIG. 5 arrangement also explicitly shows heat exchangers (or matrix coolers) 520. As mentioned elsewhere herein, flow 320 from any slot 400 located at any position may be provided to such heat exchangers 520. Purely by way of example, the FIG. 5 arrangement comprises two heat exchangers 520. One heat exchanger 520 is provided with extracted flow 320 from a slot 400 at a radially outer boundary 160 of the OGV flow passage, and the other heat exchanger 520 is provided with extracted flow 320 from a radially inner boundary 150 of the OGV flow passage.

The exit pressure applied to the slot 400 may be at least in part determined by the downstream feature/position to which the extracted flow 320 is directed. The exit pressure (and thus the feature/position to which the extracted flow 320 is directed) may be chosen so as to provide the desired flow rate of the over-turned flow through the slot 400.

It will be understood that the disclosure is not limited to the embodiments above-described and various modifications and improvements can be made without departing from the concepts described herein. Purely by way of example, a flow passage 130 (for example the endwall(s) 150 of a flow passage 130 may be provided with one slot 400 (as illustrated in the FIGS. 3 and 4 example) or more than one slot 400. Where more than one slot 400 is provided, one slot 400 may be offset in the pitch (or circumferential) direction and/or the camber (or axial) direction from another slot 400. By way of further example, the absolute length l and width w of the slot 400 may be any value as required by a particular application. For example, the entire slot 400 may be axially within the leading and trailing edge positions of the neighbouring aerofoils 110, 120 (as in the illustrated examples), or the slot may extend axially beyond one or both of the leading and trailing edges of the aerofoils 110, 120. The slot 400 may be positioned axially in the most appropriate position to extract the over-turned flow 300, which may, for example, be axially towards the trailing edge of the aerofoils 110, 120. Except where mutually exclusive, any of the features may be employed separately or in combination with any other features and the disclosure extends to and includes all combinations and sub-combinations of one or more features described herein.

I claim:

1. A flow passage comprising:

a first aerofoil having a first camber defining a first direction;

a second aerofoil having a second camber and spaced from the first aerofoil in a pitch direction; and an endwall arranged between the first and second aerofoils, wherein:

the first and second aerofoils extend from the endwall in a spanwise direction of the aerofoils;

a slot is formed in the endwall and is configured to remove boundary layer flow from the endwall via boundary layer flow flowing through the slot from an aerofoil side of the endwall to an inner side of the endwall, the slot defining a length direction, a width direction, a length dimension, and a width dimension, the length dimension being greater than the width dimension, and the length direction being more aligned with the first direction of the first camber than with the pitch direction; and a first minimum distance between the slot and a first camber line of the first aerofoil is in the range of 0.25 and 4 times a second minimum distance between the slot and a second camber line of the second aerofoil at all points along a length of the slot.

2. A flow passage according to claim 1, wherein the first and second aerofoils are substantially the same, such that the first camber of the first aerofoil is the same as the second camber of the second aerofoil.

3. A flow passage according to claim 1, wherein the length direction of the slot is within 45 degrees of the first direction of the first camber.

4. A flow passage according to claim 1, wherein the length direction of the slot is within 10 degrees of the first direction of the first camber.

5. A flow passage according to claim 1, wherein the length direction of the slot is substantially aligned with the first direction of the first camber.

6. A flow passage according to claim 1, wherein:

the slot is formed between a pressure surface of the first aerofoil and a suction surface of the second aerofoil; and the slot is an opening formed in the endwall that points towards the pressure surface of the first aerofoil.

7. A flow passage according to claim 6, wherein a first edge of the slot that is closest to the pressure surface of the first aerofoil is lower than a second edge of the slot that is closest to the suction surface of the second aerofoil.

8. A turbomachine comprising:

a flow passage including:

a first aerofoil having a first camber defining a first direction;

a second aerofoil having a second camber and spaced from the first aerofoil in a pitch direction; and an endwall arranged between the first and second aerofoils, wherein:

the first and second aerofoils extend from the endwall in a spanwise direction of the aerofoils;

a slot is formed in the endwall and is configured to remove boundary layer flow from the endwall via boundary layer flow flowing through the slot from an aerofoil side of the endwall to an inner side of the endwall, the slot defining a length direction, a width direction, a length dimension, and a width dimension, the length dimension being greater than the width dimension, and the length direction being more aligned with the first direction of the first camber than with the pitch direction; and a first minimum distance between the slot and a first camber line of the first aerofoil is in the range of 0.25 and 4 times a second minimum distance between the slot and a second camber line of the second aerofoil at all points along a length of the slot.

9. An axial flow turbomachine comprising:

at least one rotor stage comprising a plurality of rotor blades;

at least one stator stage comprising a plurality of stator vanes; and a flow passage including:

a first aerofoil having a first camber defining a first direction;

a second aerofoil having a second camber and spaced from the first aerofoil in a pitch direction; and an endwall arranged between the first and second aerofoils, wherein:

the first and second aerofoils extend from the endwall in a spanwise direction of the aerofoils;

a slot is formed in the endwall and is configured to remove boundary layer flow from the endwall via boundary layer flow flowing through the slot from an aerofoil side of the endwall to an inner side of the endwall, the slot defining a length direction, a width direction, a length dimension, and a width dimension, the length dimension being greater than the width dimension, and the length direction being more aligned with the first direction of the first camber than with the pitch direction;

a first minimum distance between the slot and a first camber line of the first aerofoil is in the range of 0.25 and 4 times a second minimum distance between the slot and a second camber line of the second aerofoil at all points along a length of the slot; and the first and second aerofoils of the flow passage are either neighbouring rotor blades of a rotor stage or neighbouring stator vanes of a stator stage.

10. An axial flow turbomachine according to claim 9, wherein:

each neighbouring pair of rotor blades in at least one rotor stage forms the flow passage.

11. An axial flow turbomachine according to claim 9, wherein:

each neighbouring pair of stator vanes in at least one stator stage forms the flow passage.

12. A turbomachine or axial flow turbomachine according to claim 8, wherein the slot is connected to a heat exchanger.

13. An axial flow turbomachine according to claim 9, wherein the slot is connected to a heat exchanger.

14. A turbomachine according to claim 8, wherein the slot is connected to a suction source.

15. An axial flow turbomachine according to claim 9, wherein the slot is connected to a suction source.

16. A method of removing boundary layer flow from flow through a stage of a gas turbine engine, the stage comprising multiple rotor blades or stator vanes extending from an endwall, the method comprising:

determining a first flow direction of mainstream flow through the stage during use;

determining a second flow direction of boundary layer flow next to the endwall during use;

providing a slot in the endwall between two neighbouring stator vanes or rotor blades, the slot defining a length direction, a width direction, a length dimension, and a width dimension, the length dimension being greater than the width dimension;

aligning the length direction more closely to the first flow direction of mainstream flow through the stage during use than to the second flow direction of boundary layer flow next to the endwall during use; and positioning the slot such that a first minimum distance between one of the stator vanes or rotor blades is in the range of 0.25 and 4 times a second minimum distance between the slot and the respective neighbouring stator vane or rotor blade at all points along a length of the slot.

17. A gas turbine engine comprising:

a rotor stage comprising rotor blades extending from a rotor endwall; and a stator stage comprising stator vanes extending from a stator endwall, wherein:

the rotor endwall and/or the stator endwall comprises a slot provided between respective neighbouring rotor blades or stator vanes, the slot configured to remove boundary layer flow from the endwall via boundary layer flow flowing through the slot from an aerofoil side of the endwall to an inner side of the endwall, the slot defining a length direction, a width direction, a length dimension, and a width dimension, the length dimension being greater than the width dimension, the length direction being more closely aligned with a streamwise direction of the main flow through the respective stage than with a direction perpendicular to the streamwise direction of the main flow through the respective stage; and a first minimum distance between the slot and one of the stator vanes or rotor blades is in the range of 0.25 and 4 times a second minimum distance between the slot and the respective neighbouring stator vane or rotor blade at all points along a length of the slot.

* * * * *